United States Patent [19]

Brasher

[11] Patent Number: 4,609,189

[45] Date of Patent: Sep. 2, 1986

[54] OPERATOR CONTROLLED VARIABLE FORCE EXERCISING MACHINE

[76] Inventor: Jerry W. Brasher, P.O. Box 15689, Baton Rouge, La. 70895

[21] Appl. No.: 633,619

[22] Filed: Jul. 23, 1984

[51] Int. Cl.[4] ..... A63B 21/06

[52] U.S. Cl. ..... 272/118; 272/129; 272/DIG. 4

[58] Field of Search ..... 272/116, 117, 118, 126, 272/129, 93, 123, 134, DIG. 4; 128/75

[56] References Cited

U.S. PATENT DOCUMENTS

| | | | |
|---|---|---|---|
| 682,988 | 11/1900 | Hazelip . | |
| 1,547,268 | 4/1924 | Sotomayor . | |
| 2,436,987 | 10/1944 | Bailleaux | 272/81 |
| 3,010,720 | 7/1960 | Allard | 272/81 |
| 3,366,104 | 1/1968 | Totsuka | 128/24 R |
| 3,573,865 | 4/1971 | Annas | 272/117 |
| 3,588,101 | 6/1971 | Jungreis | 272/117 |
| 3,840,227 | 10/1974 | Chesemore | 272/118 |
| 3,858,873 | 5/1973 | Jones | 272/81 |
| 3,936,047 | 2/1976 | Brandt et al. | 272/146 |
| 3,998,454 | 9/1974 | Jones | 272/117 |
| 4,113,250 | 9/1978 | Davis | 128/25 R X |
| 4,176,836 | 6/1977 | Coyle | 272/120 |
| 4,205,665 | 6/1980 | Burtow | 128/75 X |
| 4,272,074 | 10/1979 | Sferle | 272/134 |
| 4,361,323 | 11/1982 | Segersten | 272/118 |

*Primary Examiner*—Richard J. Apley
*Assistant Examiner*—Robert W. Bahr
*Attorney, Agent, or Firm*—David L. Ray

[57] ABSTRACT

A exercising machine in which the force placed on the user of the machine can be rapidly varied by the user while the user is exercising with the machine including a pivotal frame for holding weights, a cable connected to the weights, a force transference device connected to the cable for contacting the body of the user and applying force thereto, a motor for rotating the pivotal frame in a vertical plane to change the force exerted on the cable and a control device or switch for controlling and directing the pivotal frame to rotate in a vertical plane to a selected position.

9 Claims, 6 Drawing Figures

OPERATOR CONTROLLED VARIABLE FORCE EXERCISING MACHINE

BACKGROUND OF THE INVENTION

1. Field of the Invention

This invention relates to an apparatus for exercising the human body. More particularly, the invention relates to an exercising machine in which the force placed on the user of the machine can be rapidly varied by the user while the user is exercising with the machine.

2. Description of the Prior Art

Weight lifting devices and exercising machines are well known in the prior art. Individual weights can be added to the machines and exercising devices to increase the force applied to the body of the user or weights can be removed to decrease the force applied to the user. However, such an increase or decrease in weight cannot be accomplished by the user while he is actually using the machine and requires that the user remove himself from the machine and add or remove weights to the machine or that he employ another person to vary the weight load on the machine.

U.S. Pat. No. 4,272,074 discloses a body building apparatus having a rectangular frame which is pivotally mounted to permit the frame to assume a variety of positions with respect to the horizontal. The apparatus includes a platform slidably mounted on the frame to seat the user, along with grips on which the user may pull to move the platform against his own weight, and an adjustable spacer for fixing the incline of the frame with respect to the horizontal to vary the resistance of the platform to movement. Thus, to vary the force required to move the platform or the resistance of the platform to movement, it is necessary that the frame be pre-adjusted prior to the user mounting the frame, and the user cannot vary the resistance of the platform to movement while actually operating the frame.

U.S. Pat. No. 4,176,836 discloses a variable resistance exercising apparatus and method whereby the resistance encounter by the body part or parts being exercised is varied by moving the body part or parts along a discretely curved incline, whereby the resistance varies automatically and instantaneously commensurate with the sine of the angle of the incline. The apparatus includes a chair or movable platform for holding the torso of the body which is attached to a curved rail which varies the angle of the carriage relative to the ground as the user forces the carriage or seat upwardly, and thereby increases the force on the legs of the user as the user propels the chair upwardly. In this apparatus the rate of increase of the force on the legs of the user is pre-determined by the fixed angle of the discretely curved rail or incline and the force cannot be varied by the operator at any given position. The weight of the body at the operator is used as the resistance or force against which the operator exercises.

U.S. Pat. No. 3,998,454 and U.S. Pat. No. 3,858,873 disclose a force applying member for use in exercising machines in which the force transmitted to various parts of the body is varied. The force is varied by a spiral pulley connected to the rotating force transference member which varies the lever arm applied to a cable having vertically suspended weights at one end, the lever arm being dependent upon the radius of the spiral pulley at any selected position. The force cannot be increased by the user of the machine while using the machine since it is necessary for the user of the machine to dismount and place more weights on the cable to increase the force on the user.

U.S. Pat. No. 3,010,720 discloses an exercise rack which the user sits upon to do sit-ups which can be inclined to vary the angle of the body of the user relative to the ground to vary the force on the user's body. The angle of inclination must be adjusted prior to the user mounting the machine and cannot be varied after the user is actually exercising on the machine.

U.S. Pat. No. 2,436,987 discloses an exercising apparatus using an inclined exercising board upon which the user lies in a prone position. The angle of inclination of the exercising board can be varied to increase or decrease the stress on the user while the user is doing sit-ups or touching his toes from a prone position. The user must pre-set the board to the desired position and cannot vary its position while actually using the board.

U.S. Pat. No. 1,547,268 discloses an arm which can be inclined with the horizontal and which has a movable weight thereon, the movable weight having a cable connected thereto for transmitting force to various parts of the body of the user. The angle of inclination of the arm with the horizontal is varied by fixing the upper end of the arm on a stationary arc having a series of ratchet teeth thereon. A bolt connectable to the upper end of the movable arm engages the ratchet teeth on the arc to fix the angle of inclination of the movable arm. The movable arm cannot be moved while the operator of the machine is actually exercising with the machine, and it is necessary for the operator to cease exercising and pre-position the movable arm to established a fixed weight or force whose resistance must be over come by the user of the apparatus.

U.S. Pat. No. 682,988 discloses an exercising or rowing machine in which the force on the body of the user is varied by inclining the body of the user to various selected positions. However, the inclination cannot be accomplished by the user during operating the machine and requires that the user dismount from the machine and set the angle of inclination.

SUMMARY OF THE INVENTION

In accordance with the present invention there is provided an exercising machine in which the force placed on the user of the machine can be rapidly varied by the user while the user is exercising with the machine including a pivotal frame for holding weights, a force transference means connected to the weights, an output means connected to the force transference means contacting the body of the user and applying force thereto, a motor for rotating the pivotal frame in a vertical plane to change the force exerted on the cable and a control device or switch for controlling and directing the pivotal frame to rotate in a vertical plane to a selected position.

One of the prime advantages of the invention over the devices disclosed in the prior art is that the operator exercising with the apparatus of the invention can control and vary the amount of force which is being applied by the machine to the various parts of the operator's body. The devices disclosed in the prior art do not allow the operator to vary the force which is being applied to various parts of the operator's body while exercising, although some devices disclosed in the prior art are designed so that the force on the operator increases according to a pre-determined rate of increase as the operator moves from one position to another.

The magnitude of the force at any point in the prior art machines cannot be controlled by the operator unless the operator stops using the machine and adds weight to the machine, or an assistant adds weight to the machine at the operator's request.

In the apparatus of the present invention, a small switch or switching device actuated by the user or another person can be located so that the user or another person can actuate the switch, or other means can be utilized to actuate a motor which will change the angle of inclination of the weights connected to the pivotal weight frame and thereby vary the force on a cable connected to the weights without having to add or removed weights therefrom. The switch or other means may be actuated by the hand, foot, arm, leg or voice of the switch operator. Thus, after each cycle of the cable, or stroke upwardly and downwardly, the weight on the cable may be varied, thereby allowing the operator great flexibility in varying the amount of force which he is applying to various parts of his body. Such flexibility is desired to achieve certain body building goals.

BRIEF DESCRIPTION OF THE DRAWINGS

The invention will be more fully understood by reference to the drawings in which.

DESCRIPTION OF THE PREFERRED EMBODIMENTS

Figure 1:
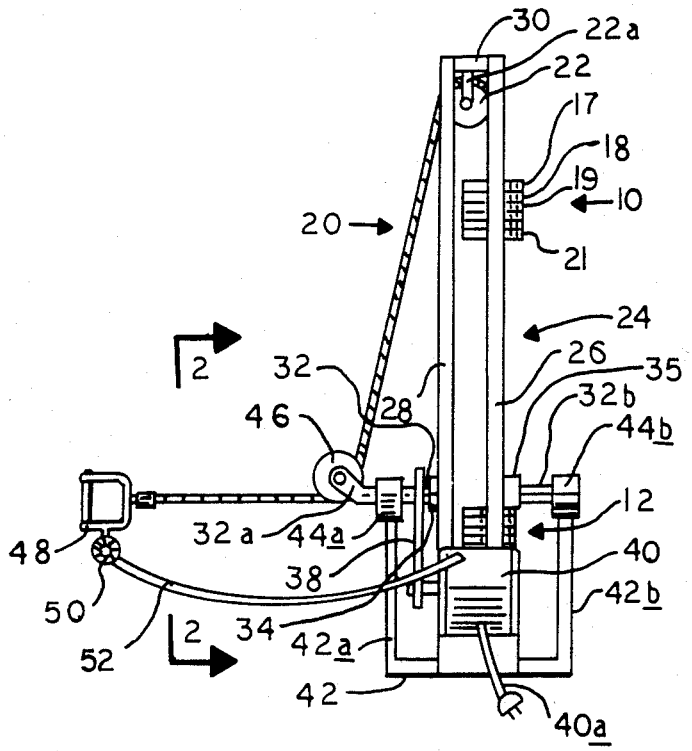
FIG. 1 is a side elevational view of the apparatus of the invention.
Figure 2:
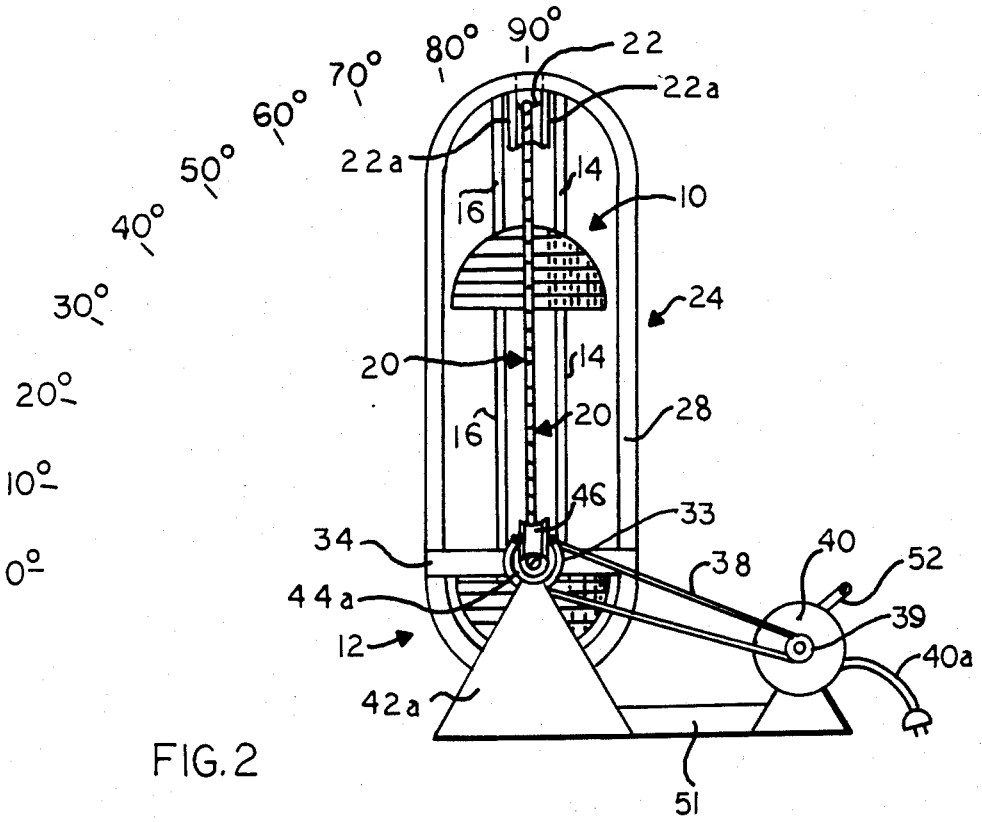
FIG. 2 is a front elevational view of the apparatus of the invention taken along lines 2—2 of FIG. 1.

Referring now to the drawings, and in particular to FIGS. 1 and 2, the exercising machine or apparatus of the invention can be seen to include a series of weights in stacks generally indicated by the numerals 10 and 12. The weights in both weight stacks have holes 11 therein through which are slidably received guide rails 14 and 16. The weight stacks 10 and 12 are formed from a plurality of individual weights 17, 18, 19, 21 and the like which can be moved from one stack to the other to increase or decrease the weight in stack 10.

Connected to weight stack 10 is a cable generally indicated by the numeral 20. Cable 20 may be a chain, rope, or the like and is used to transfer force from weight stack 10 to the body of the user of the apparatus of the invention. Cable 20 may be attached to weight stack 10 by any suitable means well known in the art such as clamping to the bottom weight 21 on the bottom weight stack 10. To increase the weight on weight stack 10, an individual weight from weight stack 12 can be attached to upper weight stack 10 in the manner well known in the art.

Cable 20 extends upwardly from weight stack 10 to rotatable upper pulley 22. Upper pulley 22 is rotatably attached to the upper portion of the frame generally indicated by the numeral 24 by pulley supports 22*a*.

Figure 3:
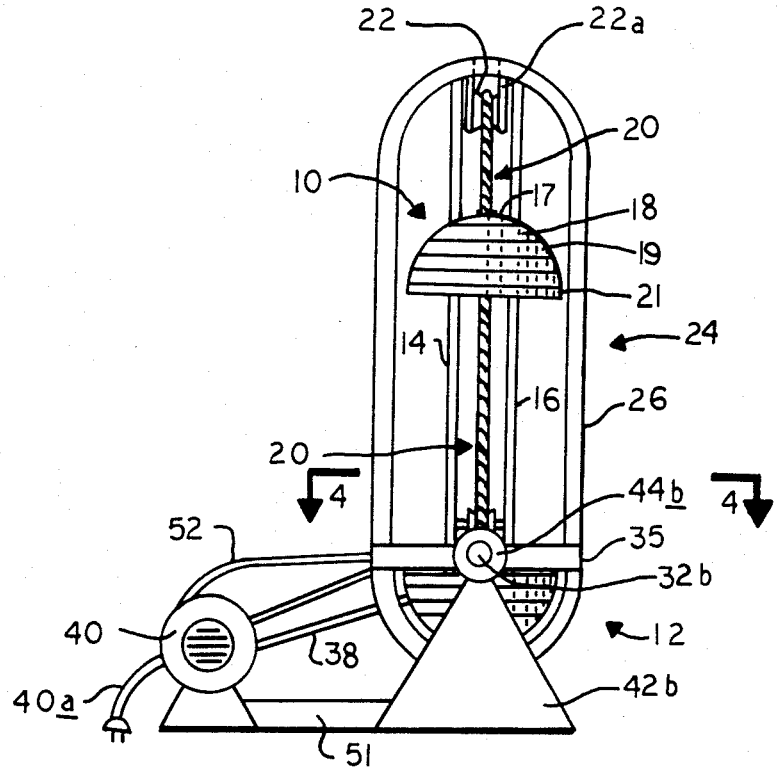
FIG. 3 is a rear elevational view of the apparatus of the invention.
Figure 4:
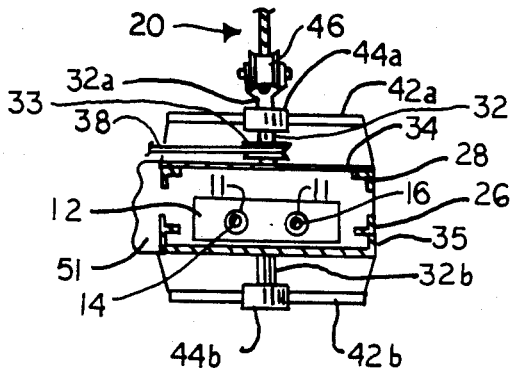
FIG. 4 is a cross-sectional view taken along lines 4—4 of FIG. 3.
Figure 5:
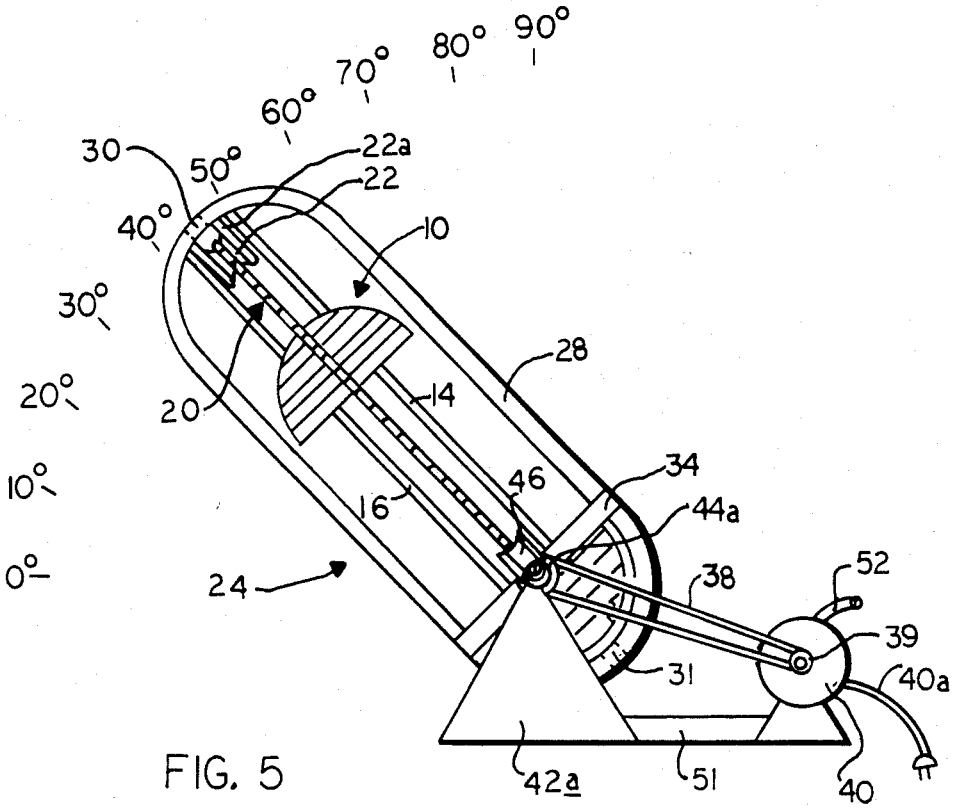
FIG. 5 is a front elevational view of the apparatus of the invention inclined at an angle with the horizontal.
Figure 6:
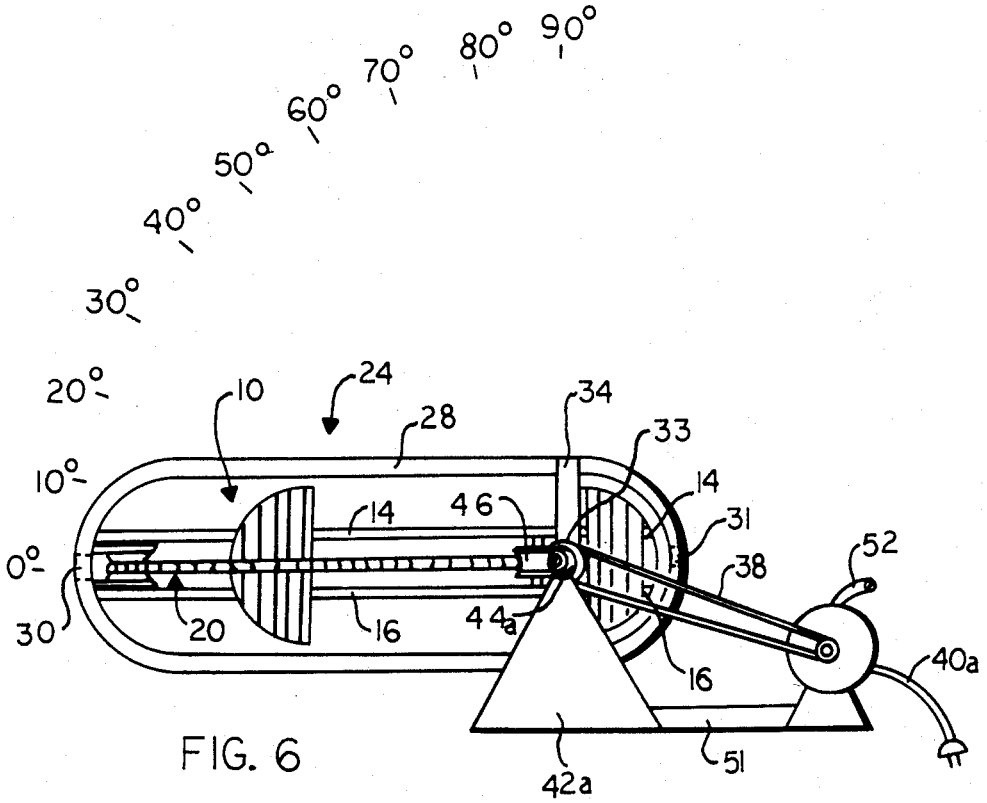
FIG. 6 is a front elevational view of the apparatus of the invention in the horizontal position.

Frame 24 includes two frame members 26 and 28 shown in FIG. 1 connected at their top by cross member 30 and at their bottom by cross member 31 shown in FIGS. 5 and 6. Shaft 32 is rigidly attached to brace 34 on frame member 28 shown in FIG. 2 and shaft 32*b* is rigidly attached to brace 35 on frame member 26 shown in FIGS. 3 and 4. Frame 26 has guide rails 14 and 16 rigidly connected thereto upon which weight stack 10 can slide upwardly and downwardly. Shaft 32 is axially aligned with shaft 32*b*.

Connected to shaft 32 is a pulley 33 which is driven by a V-belt or other flexible drive belt 38 attached to pulley 39 of electrical motor 40. If desired, a chain or gears could be substituted for belt 38 and sprockets for pulleys 33 and 39. Shafts 32 and 32*b* are rotatably connectable to the base 42 having side plates 42*a*, 42*b* by bearings 44*a*, 44*b*.

Rigidly connected at one end of shaft 32 by bracket 32*a* is rotatable pulley 46 which turns with shaft 32. Cable 20 passes under pulley 46 and is connected to handle 48 or to any other output means for applying force to the body of the user.

The electric motor 40 has a conventional electrical cord 40*a* for connection to a source of electrical energy such as a wall plug or the like. Electric motor 40 also has a switch 50 connected thereto by electrical cord 52. Motor 40 may have conventional reduction gears attached thereto, and a conventional braking or locking mechanism or any equivalent means which will prevent pulley, gears or sprocket 39 from turning when frame 24 reaches a desired position. Motor 40 could be a hydraulically or pneumatically operated motor if desired.

Switch 50 can be any switch known in the art and can be actuated by the user of the exercising apparatus or another. The switch may be located in any place desired. It can be actuated by foot, hand, leg, arm or voice, Switch 50 may be located close to handle 48 or any other similar member which transmits force to the body of the user so that the user can control the angle of frame 24 relative to the ground, and thus vary the force exerted on cable 20.

Motor 40 is preferably connected to base 42 by brace 51. Brace 51 is preferred, although motor 40 could be connected directly to the floor if desired.

As can be see in FIGS. 2, 5 and 6, the frame 24 can be tilted to any angle from 0° to 90 degrees with the horizontal. The numerals 0° degrees to 90° degrees, shown in FIGS. 2, 5 and 6 are for explanation and illustration of the invention only, and are not part of the invention.

In FIG. 2 the weight stack 10 is vertical, and the force exerted on handle 48 is equal to the weight of weight stack 10, disregarding any frictional forces that may be encountered at pulley 22 or pulley 46, or between guide rails 14 and 16 and weight stack 10. For example, if weight stack 10 weighed 75 pounds, the force exerted on cable 20 and hanel 48 would be 75 pounds.

When the frame 24 is rotated to the position shown in FIG. 5, guide rails 14 and 16 are inclined at an angle of 45 with the horizontal. The weight or force exerted on cable 20 and handle 48 is equal to the sine of 90° degrees multiplied by the weight of weight stack 10 disregarding frictional forces, which are insignificant. For example, if the weight of weight stack 10 was 75 pounds, the force exerted on cable 20 by weight stack 10 would be approximately 53 pounds.

In FIG. 6, the frame 24 is rotated to the horizontal position. In this position, no force is exerted on cable 20 by weight stack 10, and therefore there is no force exerted on the user.

It can thus be seen from the above that the user of the exercising machine of the invention can very rapidly change the amount of force being applied to cable 20 by activating switch 50 with his thumb, finger, or hand. Furthermore, and of prime importance, the user of the machine can change the amount of force being exerted on cable 20 while the user is using the machine. Thus the user can at will increase or decrease the force being placed on cable 20 by himself while he is exercising. Furthermore, the user may quickly change the force being exerted on cable 20 to zero by activating the switch to incline frame 24 to the horizontal, thus preventing injury to the user when the user cannot restrain the force exerted on the cable by weight stack 10.

While cable 20 has been shown to be connected to handle 48 to simplify the disclosure of the invention, cable 20 could be connected to any exercising machine known in the art employing a cable connected to a weight which is raised and lowered by the user. For example, the exercising machine shown in U.S. Pat. Nos. 3,858,873 and 3,998,454, which are hereby incorporated by reference, commonly referred to as "Nautilus" exercising machines, utilize a cable connected to a weight stack which the user lifts and lowers; the exercising machine of the invention could be utilized with the machine shown in U.S. Pat. No. 3,858,873 and 3,998,454 by connecting the cable 120 of the invention to the L-shaped lever assembly 60 of the above mentioned two patents.

Other exemplary applications of the exercising machine of the invention would be to machines for performing what is commonly called the "bench press" in which the user lies in a prone position on his back and lifts a bar, to which weights or a cable is attached, from the user's chest upward until his arms are fully extended. The bench press can be a dangerous exercise because the user may be unable to hold the bar above his chest, and the bar may fall to the chest or throat of the user causing severe injury. To prevent such injury it is common for a person performing the bench press to utilize one or two assistants to stand near the bar being lifted to catch the bar and prevent injury to the user if the bar begins to drop out of control. Utilizing the present invention, cable 20 could be attached to the bar to provide the force on the bar and switch 50 installed on the bar, thus allowing the user to rapidly remove all force on the bar by rotating frame 24 to the horizontal and prevent injury. Furthermore, the user can decrease or increase the force applied to the bar rapidly by himself without having to arise from the machine to add weight.

It is particularly important to achieve certain body building goals in certain body building exercises such as the bench press to be able to add weight close to the limit or maximum amount of weight a person may be able to lift. Utilizing the present invention, the user can quickly vary the weight or force which he is lifting or straining against and hereby stress the muscles to their limit or close thereto without having to use an assistant or leave the exercising machine, and without fear of being struck and injured by falling weights.

Although the preferred embodiments of the present invention have been disclosed and described in detail above, it should be understood that the invention is in no sense limited thereby, and its scope is to be determined by that of the following claims.

What is claimed is:

1. An exercising machine in which the force placed on the user of the machine can be rapidly varied by the user or another while the user is exercising with the machine comprising:

a. pivotal frame means holding movable exercising weight means, said pivotal frame means having an upper end and a lower end, said upper end having upper pulley means connected thereto for receiving movable cable means, said pivotal frame means having guide rail means upon which said movable exercising weight means are slidably received;

b. movable cable means connected to said movable exercising weight means;

c. output means connected to said movable cable means for applying the force applied to said movable cable means by said movable exercising weight means to the body of the user;

d. an axle rigidly connected to said lower end of said pivotal frame means for rotating said pivotal frame means in a vertical plane to change the force exerted by said movable exercising weights on said movable cable means, said axle having two ends, said axle means having bracket means rigidly connected to one end thereof, said bracket means having lower pulley means rotatably connected thereto to maintain the portion of said cable means extending from said lower pulley means to said output means at a constant length as said pivotal frame rotates on said axle;

e. stationary base means for rotatably supporting said axle and said pivotal frame means;

f. motor means for rotating said axle, said motor means being connected to said axle by drive means; and g. switch means connected to said motor means for selectively actuating said motor means to rotate said pivotal frame means to a desired position and thereby change the force exerted on said movable cable means by said movable exercising weight means.

2. The exercising machine of claim 1 wherein the portion of said cable means extending from said lower pulley means to said output means can be aligned with said axle.

3. The exercising machine of claim 1 wherein said pivotal frame means is supported solely by said axle.

4. The exercising machine of claim 1 wherein said switch means is connected to said output means.

5. The exercising machine of claim 1 wherein said drive means is a flexible belt means.

6. The exercising machine of claim 1 wherein said drive means is a drive chain.

7. The exercising machine of claim 1 wherein said motor means has rotatably pulley means connected thereto and said axle means has rotatably pulley means connected thereto and drive belt means connected said rotatably pulley on said motor means to said rotatably pulley on said axle means.

8. The exercising machine of claim 1 wherein said motor means is an electric motor.

9. The exercising machine of claim 8 wherein said electric motor means is rigidly connected to said stationary base means.

* * * * *